United States Patent [19]

Epstein

[11] 4,346,891

[45] Aug. 31, 1982

[54] RACKETS

[76] Inventor: David Epstein, 8A Ground floor, Tung Shan Ter., Stubbs Rd., Hong Kong, Hong Kong

[21] Appl. No.: 64,308

[22] Filed: Aug. 6, 1979

[30] Foreign Application Priority Data

Aug. 4, 1978 [GB] United Kingdom ..... 32228/78

[51] Int. Cl.[3] ..... A63B 49/02

[52] U.S. Cl. ..... 273/73 C

[58] Field of Search ..... 273/73 R, 73 C, 73 D, 273/73 G

[56] References Cited

U.S. PATENT DOCUMENTS

| | | | |
|---|---|---|---|
| 971,773 | 10/1910 | Mueller | 273/73 D |
| 3,664,668 | 5/1972 | Held | 273/73 C |
| 3,801,099 | 4/1974 | Lair | 273/73 C |
| 3,999,756 | 12/1976 | Head | 273/73 C |
| 4,196,901 | 4/1980 | Durbin | 273/73 G |

FOREIGN PATENT DOCUMENTS

| | | | |
|---|---|---|---|
| 3528 | of 1884 | United Kingdom | 273/73 D |
| 2717 | of 1909 | United Kingdom | 273/73 D |
| 197247 | 5/1923 | United Kingdom | 273/73 H |
| 427206 | 4/1935 | United Kingdom | 273/73 R |

*Primary Examiner*—Richard J. Apley

*Attorney, Agent, or Firm*—Pollock, Vande Sande & Priddy

[57] ABSTRACT

It is not always easy for a beginner to control the hitting of a ball with a tennis racket. Thus, there is only a small central area known as the sweep spot on which the ball has to impinge if it is to be hit consistently and accurately. The racket of the invention has a head with an elongated oval shape with the major axis of the oval being substantially aligned with the longitudinal axis of the handle and so a sweep spot is provided which is elongated in the direction of the axis of the handle. With such a racket, a beginner can usually hit a ball more accurately and effectively. Preferably, the racket frame has two sides which are substantially straight and parallel to one another and to the axis of the handle. A preferred manner of stringing such a racket is to use two sets of interwoven parallel strings, each set being oriented at an angle of about 45° to the axis of the handle. Such an arrangement has advantages which include the fact that the majority of the strings are of approximately the same length and so can all be tensioned to about the same extent.

3 Claims, 2 Drawing Figures

26
18
12
16
10
30
28
16
24
20
20
22
14
15

12
14
16

RACKETS

This invention relates to rackets and in particular, tennis rackets.

BACKGROUND TO THE INVENTION

A modern tennis racket has a head which has an almost circular shape which is slightly elongated in the direction of the handle which extends from the head. The head is crossed by two sets of strings, one of which extends parallel to the axis of the handle and the other of which extends at right angles thereto. To conform to the rules, it is essential that the two sets of strings be interwoven with one another.

There have been developments in recent years regarding the nature of the materials from which the racket has been made but the overall shape has remained largely unaltered for many years.

With such a racket, any reasonably competent player can hit the ball in a controlled way, e.g. with the required force and also with a degree of spin.

I have discovered, whilst teaching newcomers to the game of tennis, however, that they find difficulties in using a conventional racket to hit a tennis ball consistently and accurately.

It is therefore an object of my invention to provide a racket with which is easier for a beginner to hit a tennis ball.

BRIEF SUMMARY OF THE INVENTION

Therefore according to one aspect of the invention, I provide a racket whose head has a substantially oval shape elongated in the direction of the axis of the handle, that is to say, the major axis of the oval is substantially aligned with the longitudinal axis of the handle. As compared with a conventional modern tennis racket, therefore, the handle (including grip and neck) is somewhat shorter but the overall length of the tennis racket need not differ or differ significantly from a conventional racket, e.g., 27.

The resulting tennis racket has a strung area which is substantially in the form of an elongated oval, the two long sides of which may be approximately straight and parallel to one another and to the axis of the handle although this is not essential and those two sides joined by rounded, substantially semi-circular ends. As an example the overall length of the head in the direction of the axis of the handle can be about twice the width of the head.

I find that with such a racket, beginners to the game are able to hit a ball with more control. There is an area of a racket often called the "sweet spot" from which the best tennis shots can be played. Thus in a conventional racket, the "sweet spot" occupies a small circular area in the centre of the strung region. In my racket, however, the "sweet spot" is in the form of a very elongated oval and so is much larger in area. Also, since the racket acts as a lever when hitting a ball, the elongated region of the sweet spot is nearer the player's hand and with the resulting shorter lever, a novice can obtain greater control.

Surprisingly, I find that it is not necessary for the width of the head to be increased as compared with the width of a conventional tennis racket. Thus there have, in the past, been proposals to provide beginners with a racket with an enlarged head, that is, enlarged both in length and width, but this does not help beginners significantly since the area of the "sweet spot" is not significantly enlarged. Also, any time that a ball impinges on the strings at a position significantly spaced from the longitudinal axis of the handle of the racket, the racket is subject to a twisting action as a result of which a beginner will probably play a poor shot. In my racket, I do not find it necessary or desirable to increase the width of the head but find that elongating the "sweet spot" in the direction of the axis of the handle gives great assistance to a beginner. Also, my racket is not clumsy to use.

Although it is preferable that the opposite sides of the oval-shaped head in my racket be substantially straight and parallel to one another, this is not essential and these sides could be slightly bowed inwardly or outwardly or slightly inclined inwardly or outwardly relative to one another. The precise shape of the head will depend on the material of the frame. Thus in a wooden frame, it may be desirable for the sides to be bowed slightly outwardly whilst with a metal frame or a composite frame made of metal and foam plastics, these two sides can be straight and parallel.

I also find that my racket has the advantage for a competent or expert player in that, when volleying, such a player can return a ball from a position closer to his body than with a conventional racket.

Because of the new shape given to the head of my tennis racket, I find that it is desirable although not essential that it be strung with two sets of parallel strings which, whilst still crossing one another at about 90° and being interwoven are each desirably oriented at about 45° to the longitudinal axis of the handle of the racket.

This has a number of advantages in combination with a frame of the shape I propose. Thus, the majority of strings are of approximately the same length with the result they can all be tensioned to approximately the same extent and will all have approximately the same characteristics. This results in an evenness of return of a tennis ball from a large portion of the strung area of the racket. In contrast in conventional tennis rackets, the length of the strings varies progressively from short to long and back to short again both across the face of the racket and along the length of the face of the racket.

I have also found that when a tennis racket is strung in this way with the two sets of strings interwoven and the two sets of strings angled at right angles to one another and at about 45° to the axis of the handle of the racket, I can give improved spin to the ball when hitting the ball. This is of course a most desirable property particularly when tennis is played at top amateur or professional standards.

Therefore, according to another aspect of the invention, there is provided a tennis racket whose head is strung with two sets of crossed and interwoven strings, the set of strings being oppositely inclined at an angle of approximately 45° to the axis of the handle of the racket.

The improvement I find with regard to being able to impart increased spin to tennis ball appears to be achieved whether the racket head has a conventional shape or the elongated oval shape referred to above.

BRIEF DESCRIPTION OF THE DRAWINGS

A tennis racket according to the invention will now be described, by way of example, with reference to the accompanying drawings, in which:

FIG. 12 is a side view of that racket.

DESCRIPTION OF THE PREFERRED EMBODIMENTS

Figure 1:
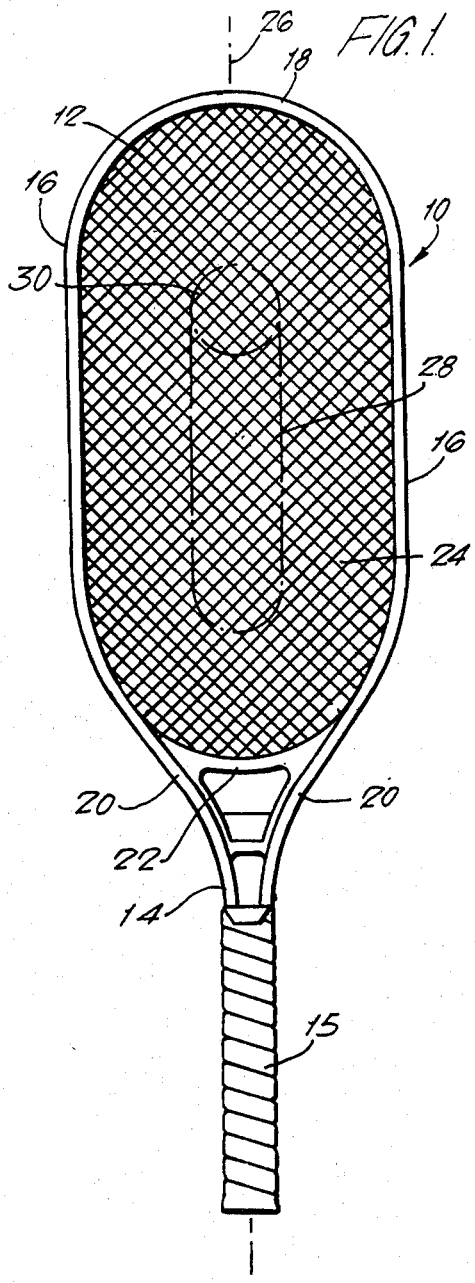
FIG. 1 is a plan view of a racket according to my invention.
Figure 2:
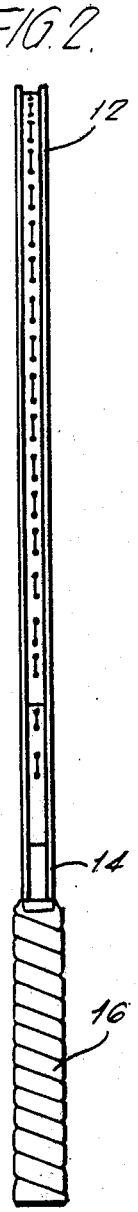

The racket 10 shown in the drawings has a head 12 and a handle 14 comprising a neck and grip. Preferably, the overall length of the racket is approximately the same as that of a conventional tennis racket, e.g., 27″. However, the length of the handle is much shorter and is constituted almost entirely by a grip 15 whose length is preferably sufficient to enable a player to use the racket two-handed accordingly, the remainder of the handle, the neck is much smaller than conventional.

The racket 10 has a frame made of for example "I" section aluminium which extends into the handle. The shape of the head is in the form of an elongated oval with two parallel sides 16, a rounded head region 18 and shoulder portions 20 which unite the head with the handle. Between the shoulder portions 20 is a centre piece 22, e.g. of plastics material, which defines a rounded inner end to the head.

The racket is strung with two sets of strings 24. The two sets of strings cross one another at approximately right angles and are each inclined, but in opposite directions, at an angle of approximately 45° to the longitudinal axis 26 of the racket. The two sets of strings are interwoven in a manner similar to a woven fabric as is essential for a tennis racket.

The shape of the head gives important advantages particularly for a beginner to the game of tennis. Outlined in broken lines is an area 28 known as the "sweet spot" which is the area from which a good return of a tennis ball can be achieved. The corresponding "sweet spot" area for a conventionally shaped tennis racket is delineated by the broken line 30. As can be seen, the "sweet spot" area for my racket is significantly larger and this is of considerable assistance to beginners. Also, the "sweet spot" 28 in my racket is elongated in the direction of the axis 26 and so is not enlarged in a direction transverse to that axis. Further, if a ball is hit in the elongated area of the sweet spot 28 outside the area 30, this is nearer the grip 15 so that the resulting lever is shorter so giving more control in hitting a ball to a novice.

In addition, the direction of the strings 24 has a number of important advantages. Amongst these are firstly the fact that most strings are of approximately identical lengths and so have roughly the same characteristics and the fact that when the two sides of strings are both angled at 45° to the axis 26, instead of one set being parallel to that axis and the other set being transverse to that axis, I find that I can give increased spin to a tennis ball when hitting it.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. A tennis racket comprising:

a head, a grip whose length is sufficient for two handed use, a neck portion joining said head and said grip, said neck portion and said grip comprising a handle, an open frame defining said head and comprising two sides which are substantially straight and parallel to one another and to the axis of the handle and rounded substantially semi-circular ends joining said two sides, said frame having a width which is approximately 9″, the racket having an overall length which is approximately 27″ with said frame about twice as long as said width of said frame, whereby the neck is much shorter than in a conventional tennis racket, two sets of strings extending across said open frame to define a strung area, said sets of strings comprising parallel strings in each set, said strings of one set crossing said strings of said other set at an angle of about 90°, and said strings of said two sets being interwoven with one another, a sweet spot defined by said strung area, said sweet spot being in the shape of an elongated oval whose elongation is substantially parallel to and extends along the line of said axis of the handle, and said sweet spot extending substantially closer to the handle than in a conventional tennis racket.

2. The tennis racket of claim 1 in which the length of the head in the direction of the axis of the handle is such that the handle comprises essentially only the grip.

3. The tennis racket of claim 1 in which each of said set of strings is oriented at about 45° to a longitudinal axis of said tennis racket.

* * * * *